United States Patent [19]

Yoshimura et al.

[11] 4,180,811

[45] Dec. 25, 1979

[54] DETECTING DEVICE FOR DESTRUCTIVE VIBRATION OF STRUCTURES

[75] Inventors: Tadashi Yoshimura, Tsu; Tohru Hanahara, Hirakata; Toshio Abiko, Daito; Kazuhiro Matsuoka, Shijonawate, all of Japan

[73] Assignee: Matsushita Electric Works, Ltd., Osaka, Japan

[21] Appl. No.: 802,580

[22] Filed: Jun. 1, 1977

[30] Foreign Application Priority Data

Oct. 22, 1976 [JP] Japan ..... 51-127488

[51] Int. Cl.[2] ..... G08B 13/04

[52] U.S. Cl. ..... 340/566; 73/594; 340/550

[58] Field of Search ..... 340/261, 274 R, 276, 340/213 R, 421, 550, 565, 566; 109/38, 42; 73/579, 594, 612, 649, 654, DIG. 1

[56] References Cited

U.S. PATENT DOCUMENTS

| | | | |
|---|---|---|---|
| 3,391,571 | 7/1968 | Johanson | 73/67 |
| 3,585,581 | 6/1971 | Aune et al. | 340/16 |
| 3,713,128 | 1/1973 | Wong et al. | 340/261 |
| 3,889,250 | 6/1975 | Solomon | 340/274 |
| 3,947,835 | 3/1976 | Laymon | 340/261 |
| 4,054,867 | 10/1977 | Owens | 340/274 R |
| 4,088,989 | 5/1978 | Solomon | 340/550 X |

*Primary Examiner*—John W. Caldwell, Sr.
*Assistant Examiner*—Joseph E. Nowicki
*Attorney, Agent, or Firm*—Burns, Doane, Swecker & Mathis

[57] ABSTRACT

A detecting device for destructive vibration of structures wherein detected vibration is converted into electric signal and an alarm is actuated when signal amount reaches at least one of a predetermined counting value and integration value is provided. The converted vibration signals are amplified, a high level signal in such amplified signals is detected and amplified by a high level detector, a high level output of this detector is counted by a counter to generate a counter output when the predetermined counting value is reached, a low level signal in the amplified signals is detected and amplified by a low level detector, a low level output of this detector is integrated by an integrating circuit to generate an integration output when the predetermined integration value is reached, and the alarm is actuated whenever at least one of the counter output and integration output is provided.

2 Claims, 10 Drawing Figures

DETECTING DEVICE FOR DESTRUCTIVE VIBRATION OF STRUCTURES

This invention relates to devices for detecting destructive vibrations of structures and, more particularly, to improvements in destructive vibration detecting devices which detect vibrations or shocks caused in the case when any person who attempts to intrude in a building structure tries to destroy the same so that such intentional destructive action to the structure will be discovered and alarmed.

For available measures for such intruders who try to destroy such a part of building structures as a wall, floor or ceiling, generally, there will be mostly two alternative measures, in the former of which a chisel is hit by a hammer into the structure and in the latter of which an electric drill or the like tool is used to drill through or grind off a part of the structure. According to experimental researches made by the present inventors, it has been found that, with the former measure, the structure repeats a single vibration which has a relatively high wave height value and attenuates instantaneously and, with the latter measure, vibrations of a relatively low level and continuous are generated in the structure.

Heretofore, there has been suggested in, for example, the U.S. Pat. No. 3,947,835 a destructive vibration detecting device of the kind referred to according to which the destructive vibration or vibrations will be converted into electric signals and the amount of the signals is integrated or the number of pulses of the signals is counted to detect a presence of any abnormal state due to the destruction. In this device, however, there is involved a defect in respect of operational reliability because such vibratory level difference as referred to in the above in the two different situations is not taken into considerations. According to the present invention, the problem has been successfully solved by detecting at the respective different levels such vibrations of the respective different situations to thereby improve the above defect. That is, the present invention relates to a destructive vibration detecting device in which output pulse number of high level detector is counted for the purpose of detecting the destructive action by means of the chisel and output sequence time of low level detector is measured for the purpose of detecting the destructive action by means of the electric drill or the like so that the two different situations can be detected separately.

Further, conventional destructive vibration detecting devices are to be generally mounted to a wall surface of building structures and, in the case when the devices are mounted to a wall having a crack or cracks that will intercept propagations of the vibration or to a wall covered with such a soft ornamental material as cloth, leather or the like which does not propagate the vibration therethrough, the vibration is not propagated to the device well enough for actuating the same.

According to the present invention, the detecting device is mounted to the wall with a mounting member as a basis which reaches the interior of the wall body so that the device can be sensitive to the vibration which propagates through the interior or core part of the wall, whereby any sequential vibrations of even a relatively low level can be positively sensed and thus any vibrations of such different situations as disclosed above can be reliably detected.

A primary object of the present invention is, therefore, to provide a destructive vibration detecting device having a detecting ability which is adaptable to possible difference in destructive measure to building structure.

Another object of the present invention is to provide a destructive vibration detecting device that can detect the vibration reliably and stably even when the device is installed on a wall which having a crack or cracks which will intercept the propagation of the vibration or being covered with a soft and vibration adsorptive ornamental material or the like.

A further object of the present invention is to provide a destructive vibration detecting device which is capable of removing any factors of misoperations of the device in a simple manner.

Other objects and advantages of the present invention shall be made clear upon reading the following disclosures of the invention detailed with reference to accompanying drawings, in which.

Figure 1:
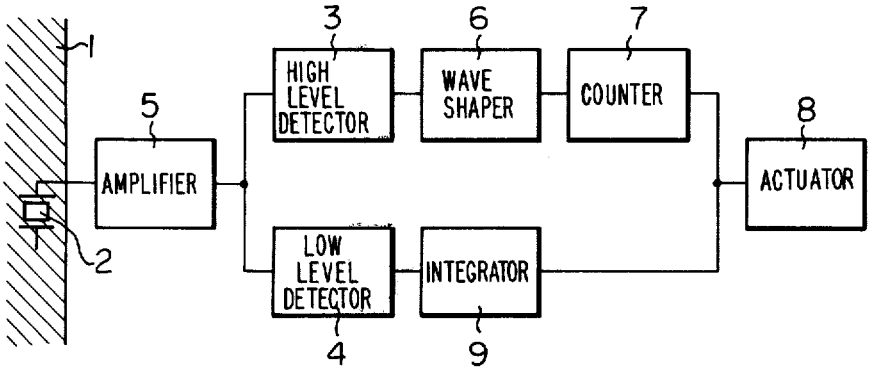
FIG. 1 is a block diagram of the destructive vibration detecting device according to the present invention.

While the present invention shall now be referred to with reference to its preferred embodiments shown in the drawings, it should be understood that the intention is not to limit the invention only to the embodiments shown but rather to include all possible modifications, alterations and equivalent arrangements within the scope of appended claims.

Figure 2A:
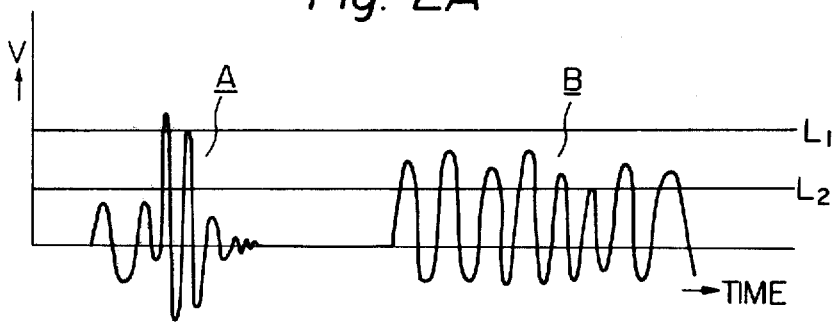
FIGS. 2A through 2D are wave form diagrams for explaining the operation of the device shown in FIG. 1.
Figure 2B:
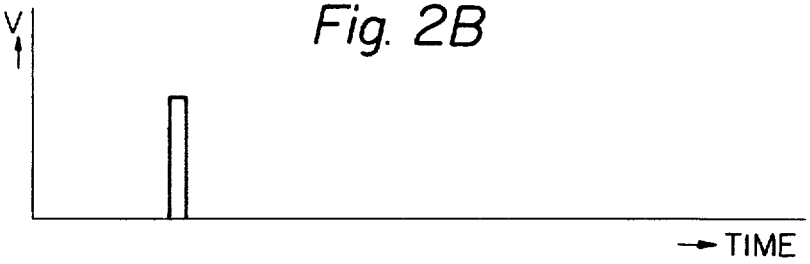
Figure 2C:
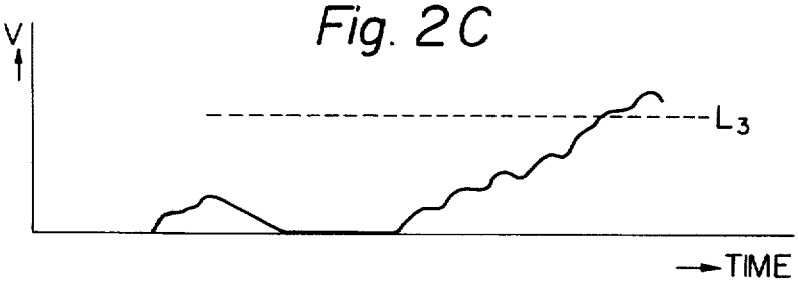
Figure 2D:
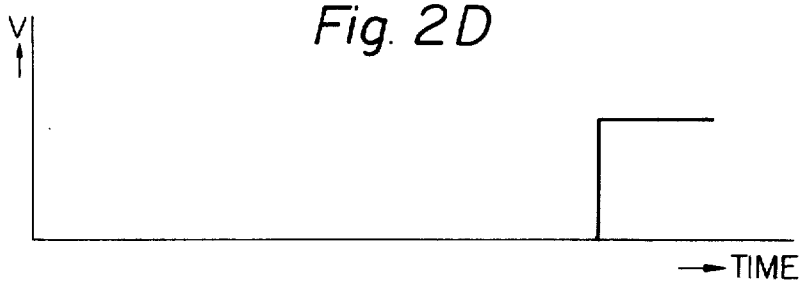

Referring to FIG. 1, any vibration of a wall 1 due to an intentional destruction is detected by a detecting element 2, a detection output of the element 2 is provided to an amplifier 5, in which the output is amplified and this amplified output is presented to a high level detector 3 and a low level detector 4, respectively. The high level detector 3 has a detecting level $L_1$ preliminarily set therein and detects only an output signal of the amplifier 5 having such a high peak value which is generated at the time of a destruction by means of the chisel as shown by A in FIG. 2A, and this detector 3 is formed so as to generate such an output pulse signal as shown in FIG. 2B. On the other hand, the low level detector 4 has a detecting level $L_2$ preliminarily set therein and lower than the level $L_1$ of the detector 3 and detects at this level $L_2$ such sequential signal as shown by B in FIG. 2A which is of a relatively low level. Output signals of the detector 4 which are exceeding the level $L_2$ are integrated by an integrating circuit 9 as shown in FIG. 2C and, when its integrated value exceeds a level $L_3$, the circuit 9 generates such an output signal as shown in FIG. 2D, thereby an actuating circuit 8 is actuated. The output pulse signal of the high level detector 3 is presented to a wave-shaping circuit 6 to be shaped therein into a predetermined wave form and is thereafter presented to a counter circuit 7, which provides an output to the actuating circuit 8 when a predetermined number of the output pulse signals preset in the circuit 7 are received, so that an associated alarming device (not shown) will be operated.

Figure 3:
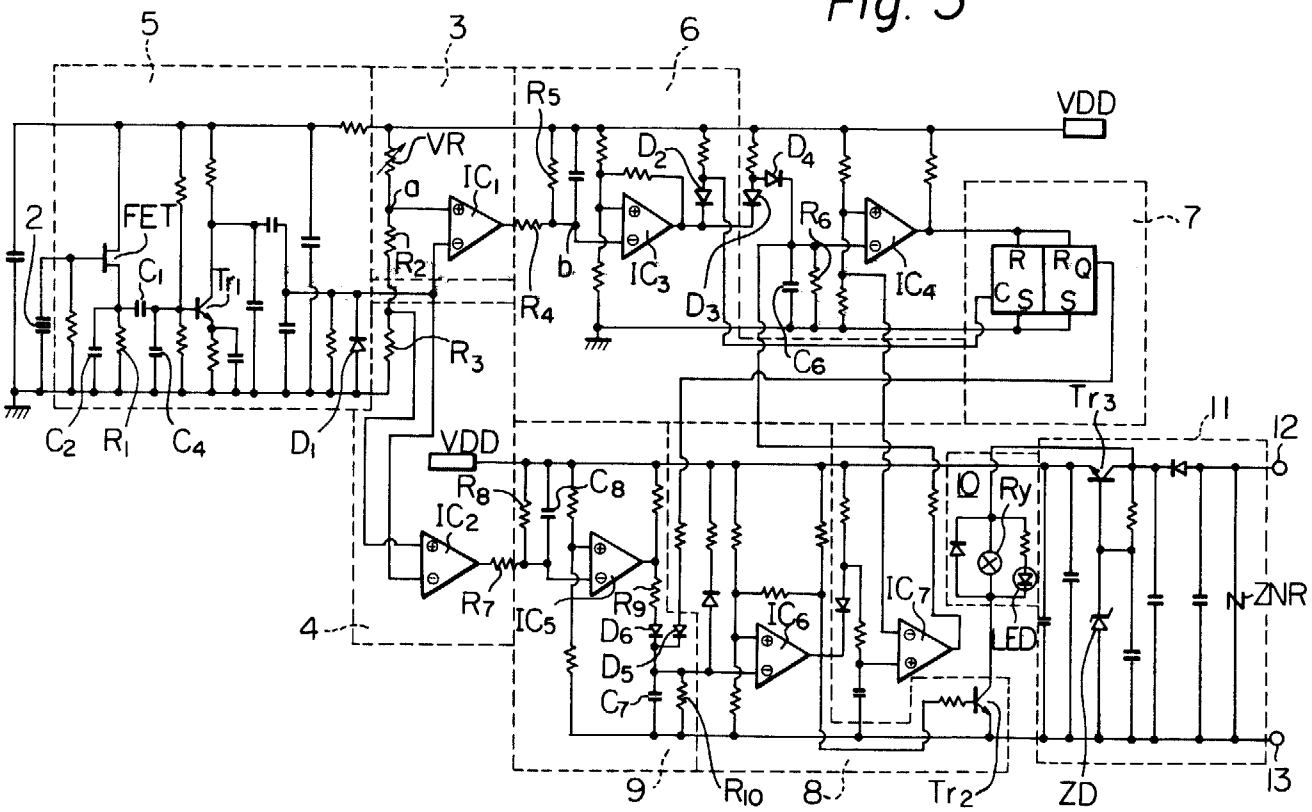
FIG. 3 is a circuit diagram of a practical embodiment of the present invention.

Referring next to a practical embodiment of the detecting device according to the present invention as shown in FIG. 3, respective reference numerals for blocks defined by dotted lines indicate the same components as those in the block diagram of FIG. 1. Block 10 shows an alarming and indicating circuit, and block 11 is a constant voltage circuit for rendering a direct current source voltage applied to terminals 12 and 13 to be constant.

In block 5 denoting an amplifier, an output from the detecting element 2 is presented to the gate of a field effect transistor FET, an output of the transistor FET is presented through a filter comprising a resistor $R_1$ and condensers $C_2$, $C_4$ and $C_1$ and passing an oscillation of about 2 KHz to the base of a transistor $Tr_1$ to be amplified. An output pulse of the transistor $Tr_1$ of which negative side only is cut off by means of a diode $D_1$ is given to inverting input terminals of operational amplifiers $IC_1$ and $IC_2$ respectively forming the high level and low level detectors 3 and 4. To a non-inverting input terminal of the operational amplifier $IC_1$, a direct current voltage VDD is applied from a junction of resistors VR and $R_2$ and, to a non-inverting input terminal of the operational amplifier $IC_2$, a junction of resistors $R_2$ and $R_3$ is connected, whereby any high level pulse in input pulses to the detectors is detected by the amplifier $IC_1$ and any low level pulse is detected by the amplifier $IC_2$. It is preferable in view of experimental results to select the ratio of the levels $L_1$ and $L_2$ to be $L_1:L_2=1:0.5$ to 0.6. An output of the operational amplifier $IC_1$ is presented to the wave-shaping circuit 6.

In this wave-shaping circuit 6, a first stage wave form shaping is performed by means of resistors $R_4$ and $R_5$ and condenser $C_5$, in which the resistor $R_4$ is set to be low (preferably about 100Ω) and the resistor $R_5$ is set to be high (preferably about 470Ω) so as to obtain a wave form which gradually discharges at the rising, and a second stage wave form shaping is performed next by means of an operational amplifier $IC_3$ so that a complete rectangular wave will be obtained, whereby any occurrence of counting miss is prevented.

Figure 4A:
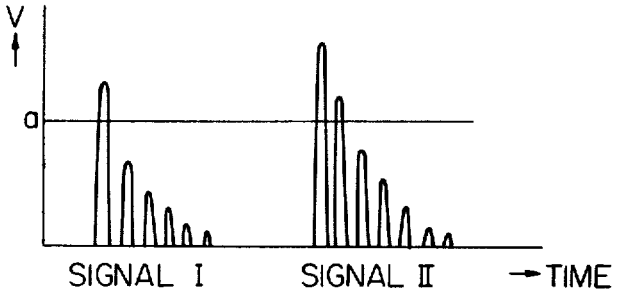
FIGS. 4A through 4C are wave form diagrams for explaining the operation of the circuit shown in FIG. 3.
Figure 4B:
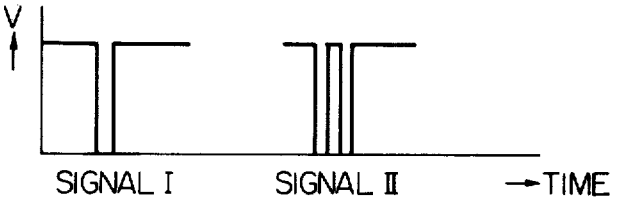
Figure 4C:
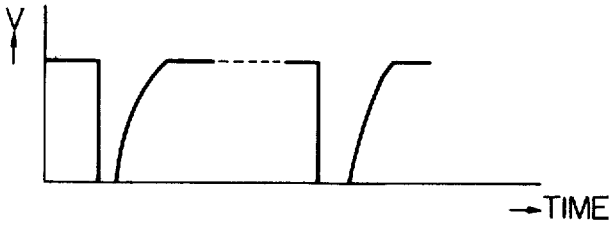

In the detector block 3, setting level at point "a" is taken to be level "a" in the diagram of FIG. 4A so that, when such signal I as in FIG. 4A enters, the output of the amplifier $IC_1$ will be a single pulse as shown by signal I in FIG. 4B. If, on the other hand, there comes such signal having a large amplitude as shown by signal II in FIG. 4A, the same exceeds the level "a" more than twice at its attenuating oscillation so that, for example, two pulses such as shown by signal II in FIG. 4B appear. If this signal is transmitted to the later described counter as it is, the signal is to be counted as being two even actual destructive action is once. For this reason, time constants of the resistors $R_4$ and $R_5$ and of condenser $C_5$ are properly set so that the wave form shaping will be performed to obtain such signals as shown by signals I and II in FIG. 4C, respectively, and the detection will be made as a single counting.

The counting circuit block 7 shall be referred to next.

This counter normally does not perform the counting as its reset terminal R is made high and reset but, when the reset terminal R is made low and a pulse is applied to a terminal C, it performs the counting. When a pulse appears at the output terminal of the operational amplifier $IC_3$, this pulse is presented through a diode $D_2$ to the terminal C of the counter 7 but is not counted since the reset terminal R is high. This pulse is further applied through diodes $D_3$ and $D_4$ to a time constant circuit comprising a condenser $C_6$ and resistor $R_6$, whereby the pulse is provided with a certain time lag and is presented to an operational amplifier $IC_4$ so that an output of this amplifier will be low and the reset terminal R of the counter 7 will be made to be low. When a second pulse is provided by the operational amplifier $IC_3$, this pulse is counted and, at the same time, charges the condenser $C_6$ again through the resistor $R_6$ to maintain the reset terminal R of the counter 7 to be continuously low. When a third pulse comes in, the same is counted by the counter 7 and an output provided to an output terminal Q, which output charges a condenser $C_7$ through a diode $D_5$. With the charge of this condenser $C_7$, the alarming and indicating circuit is actuated as will be detailed later.

The low lever signal is presented to the operational amplifier $IC_2$ and, after wave-form shaped by resistors $R_7$ and $R_8$ and condenser $C_8$ and further by an operational amplifier $IC_5$ forming the integrating circuit 9, charges the condenser $C_7$ through a resistor $R_9$ and diode $D_6$. When charging voltage of the condenser $C_7$ reaches a predetermined value, there appears an output at an output terminal of an operational amplifier $IC_6$ forming the actuating circuit 8. In other words, the operational amplifier $IC_6$ is an element for performing a level discrimination of the charging voltage of the condenser $C_7$. A resistor $R_{10}$ is an element for rendering a discharge of the condenser $C_7$ to be gradual and it is preferable that the same will form together with the condenser $C_7$ a time constant circuit which causes the output of the operational amplifier $IC_6$ to continue for about 10 seconds. When the output of the operational amplifier $IC_6$ becomes low, this output is presented to the base of a transistor $Tr_2$ in the actuating circuit 8 so as to make this transistor $Tr_2$ to be in OFF state, so that a relay Ry in the alarming and indicating circuit 10 will be made OFF, whereby associated contacts (not shown) are actuated to generate an alarm signal. LED denotes a photoelectric diode for visually indicating the alarm.

Next, an arbitrary resetting function of the device shown in FIG. 3 shall be referred to, which function is to provide an output after counting necessarily three pulses from the termination of the alarming.

During watching state, the output of the operational amplifier $IC_6$ is high and output end of an operational amplifier $IC_7$ is collector open.

At the time of the alarming, the output of the operational amplifier $IC_6$ is low whereas the output end of the operational amplifier $IC_7$ is short-circuited. In this case, the condenser $C_6$ is rapidly discharged, the output end of the operational amplifier $IC_4$ is made high whereas the reset terminal R of the counter 7 is high, so that the counter will be arbitrarily reset. This state is retained while the alarming continues and is released when the alarming is terminated.

Figure 5:
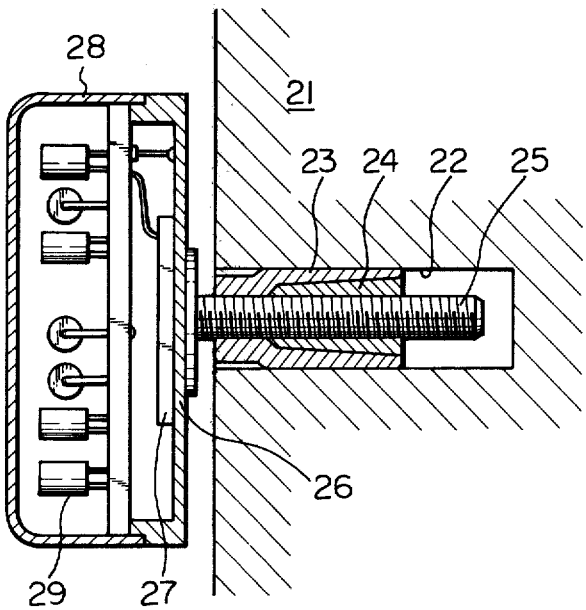
FIG. 5 is a sectional view showing mounting state of the device to a structure.

Referring next to FIG. 5 showing a practical one of the device according to the present invention, a hole 22 is made in a wall 21 and a sleeve 23 which is a substantially cylindrical elongated member in its outer shape and expandable at a foot part is inserted into the hole 22 as an elongated detecting member of the device. In an axial hole of the sleeve 23, a tapered nut 24 substantially of a conical shape and having an axial threaded hole is inserted and a bolt 25 is screwed into the axial threaded hole. At the top of this bolt 25, a mounting base 26 is fixed and a piezoelectric element 27 is mounted to the base 26. A lid member 28 is fitted over the base 26 and inside this lid 28 the detecting circuit is housed. In installing the device to the hole 22 of the wall 21, the hole 22 is made to be slightly larger than outer diameter of the sleeve 23, the tapered nut 24 is inserted into the hole of the sleeve 23, the bolt 25 is screwed into the nut 24 and thereafter the whole is inserted into the hole 22. Then the bolt 25 is rotated, whereby the tapered nut 24 is caused to enter the hole in the sleeve 23 so as to increase their mutual engagement so that the foot part of the sleeve 23 is gradually expanded outward and thus the sleeve 23 intimately tightly engages the inner periphery of the hole 22.

With such structure, any vibration of the interior part of the wall 21 can be well sensed by the piezoelectric element 27 through the sleeve 23. While the conventional devices of the kind referred to have been installed on the structure wall surface by means of an adhesive or the like so that the vibration inside the wall has been attenuated or intercepted by the covering member on the wall surface or the cracks of the wall and so on, the present invention enables it possible to effectively detect the vibration yielded in the wall at a high efficiency without being influenced by the wall covering member, cracks and the like.

What is claimed is:

1. A detecting device for detecting vibration of structures comprising: a detecting element for detecting any vibration of the structure, an amplifier for amplifying output pulses from said detecting element, a high level detector for detecting and amplifying high level outputs of the output pulses from said amplifier, a counter which generates an output when a predetermined number of high level outputs from said high level detector are counted, a wave form shaping circuit including a time constant circuit inserted between said amplifier and said counter for shaping the outputs from the high level detector into a predetermined shape recognizable by the counter, a low level detector for detecting low level outputs of the output pulses from the amplifier, an integrating circuit to which an output of said low level detector is presented, an alarming circuit to which outputs of said integrating circuit and counter are presented; and a condenser charged by an output of said wave shaping circuit for releasing said counter from a reset state for a fixed time, said condenser being grounded when said alarming circuit receives an input signal so that the counter will be arbitrarily reset by a relay in said alarming circuit.

2. A detecting device according to claim 1 which is installed to the structure through an elongated detecting member reaching the interior of the structure, and said elongated detecting member is directly coupled to said detecting element to form a substantially integral vibratory system.

* * * * *